United States Patent [19]

Yamashita et al.

[11] 4,166,235

[45] Aug. 28, 1979

[54] MAGNETRON COMPRISING FERROMAGNETIC MATERIAL MEMBERS AXIALLY MAGNETIZED IN OPPOSITE DIRECTIONS

[75] Inventors: Seizi Yamashita, Katsuta; Tunehiro Endo, Hitachi; Yoshio Ishida, Mobara, all of Japan

[73] Assignee: Hitachi, Ltd., Japan

[21] Appl. No.: 841,915

[22] Filed: Oct. 13, 1977

[30] Foreign Application Priority Data

Oct. 16, 1976 [JP] Japan ..... 51-124273

[51] Int. Cl.[2] ..... H01J 25/50

[52] U.S. Cl. ..... 315/39.71; 315/39.51

[58] Field of Search ..... 315/39.51, 39.71, 39.75

[56] References Cited

U.S. PATENT DOCUMENTS

| | | | |
|---|---|---|---|
| 3,984,725 | 10/1976 | Cook et al. | 315/39.71 |
| 3,987,333 | 10/1976 | Nakada et al. | 315/39.71 |
| 3,989,979 | 11/1976 | Konno et al. | 315/39.71 |
| 4,039,892 | 8/1977 | Kerstens | 315/39.71 |
| 4,048,542 | 9/1977 | Miura | 315/39.71 |
| 4,063,129 | 12/1977 | Miura et al. | 315/39.71 |

*Primary Examiner*—Saxfield Chatmon, Jr.
*Attorney, Agent, or Firm*—Craig and Antonelli

[57] ABSTRACT

A magnetron comprising a cathode, an anode cylinder having a plurality of vanes disposed around the cathode for defining an interaction space between the cathode and the vanes, and a pair of permanent magnets disposed opposite to each other for producing a magnetic field in the interaction space. One of the permanent magnets is annular in shape, and this annular magnet is magnetized relative to the other magnet so that their same poles confront each other thereby reducing the size of the magnetron.

7 Claims, 2 Drawing Figures

MAGNETRON COMPRISING FERROMAGNETIC MATERIAL MEMBERS AXIALLY MAGNETIZED IN OPPOSITE DIRECTIONS

BACKGROUND OF THE INVENTION

This invention relates to magnetrons, and more particularly to a magnetron in which a pair of permanent magnets are disposed with their same poles confronting each other.

In prior art magnetrons, permanent magnets were located outside the anode cylinder, and magnetic yokes were provided to form magnetic circuits together with the permanent magnets. In the magnetron of this kind, the amount of leakage flux was large, and the utilization efficiency of magnetic field was extremely low or only in the order of a few percents due to the fact that the permanent magnets were located remote from the interaction space defined between the cathode and the anode. For this reason, it was necessary to increase the size of the permanent magnets and yokes for the purpose of providing a magnetic field of required strength, in contradiction to the demands for reductions in the size and cost of the magnetron of this kind.

Recently, it has been proposed to dispose the permanent magnets within the tube of such a magnetron for the purpose of increasing the utilization efficiency of the magnetic field thereby decreasing the weights of the permanent magnets and yokes to attain the desired reductions in the size and cost.

However, there is an inevitable limitation in the material of permanent magnets to be disposed within the tube since magnets tending to liberate gases into the internal space of the tube are not fit for use. Practically utilizable materials for the permanent magnets have thus been limited to rare-earth-cobalt compounds, alnico and the like.

Such a magnetron, that is, a magnetron of the type having a pair of permanent magnets disposed within the tube is disclosed in, for example, U.S. Pat. No. 3,987,333. The disclosd magnetron comprises an anode cylinder of a magnetic material such as iron, a plurality of vanes secured to the inner wall of the anode cylinder to constitute a cavity resonator, and a cathode supported on the axial centerline of the anode cylinder. A pair of permanent magnets are disposed opposite to each other within the anode cylinder, and a pair of pole pieces are fixed to these permanent magnets respectively.

Therefore, the magnetic flux emanating from one of the permanent magnets passes through the pole piece fixed to that magnet to spread into the interaction space and then passes through the pole piece of the other magnet to enter this latter magnet. The magnetic flux entering this second magnet passes then through the anode cylinder to return to the first magnet.

In the magnetron of this kind, the interaction space required for producing the magnetic field is the space defined between the cathode and the anode. This interaction space is in the form of a cylinder having an inner diameter of about 5 mm and an outer diameter of about 10 mm, and it requires an axial length of about 8 to 10 mm although this axial length varies somewhat depending on the output of the magnetron.

The problem with the magnetic circuit in the magnetron of this kind is therefore how efficiently and inexpensively the required magnetic field can be produced in this interaction space. The magnetic field produced in this interaction space is required to have a strength, which should be varied depending upon the anode voltage, and a value of about 1,800 gauss is generally required for the anode voltage of 5 kilovolts. Further, it is required for the interaction space to produce a uniform magnetic field from the viewpoint of the stability of oscillation of the magnetron.

The structure of the cathode in the magnetron of this kind is generally classified into two types, and the structure of the permanent magnet and its pole piece located nearer to the cathode varies depending on the cathode structure.

In one cathode structure, a wide spacing is provided between the leads for the heater of the cathode, and a permanent magnet is disposed between these leads. In this case, the root portions of these two leads are superposed above the magnet with an insulator interposed therebetween, and a sufficient insulation distance must be provided between the vertically superposed root portions of the leads and the upper surface of the permanent magnet located nearer to the cathode. The above necessity results inevitably in the increase in the thickness of this part of the magnetron. Consequently, the gap length in the magnetic circuit is extended, and the actual interaction space is displaced upward relative to the center of the distance between the pole pieces of the upper and lower permanent magnets. That is, the upper portion of the interaction space approaches the upper permanent magnet, while the lower portion of the interaction space recedes from the lower permanent magnet. Therefore, non-uniformity occurs in the strength of the magnetic field produced in the interaction space, and it becomes necessary to increase the outer diameter of the lower permanent magnet in order to compensate for this non-uniformity of the field strength. Thus, even when a magnet of a rare-earth-cobalt compound is employed as this lower permanent magnet, the magnetron is more expensive than that using a strontium ferrite magnet presently commonly employed in this field.

In the other cathode structure, the cathode leads have a narrow spacing therebetween to be led to the exterior through the center of a permanent magnet, as shown in U.S. Pat. No. 3,987,333 cited hereinbefore. In this case, it is necessary to make the permanent magnet annular in shape. However, employment of such an annular permanent magnet affects adversely the magnetic field distribution along the inner peripheral portion of the interaction space, and the size of the specific permanent magnet and its pole piece must be increased to make uniform the magnetic field distribution in the interaction space. The volume of the specific permanent magnet is thus increased resulting in the increase in the cost of the magnetron.

It will be seen from the above discussion that how to rationally arrange the magnetic circuit in the vicinity of the permanent magnet located nearer to the cathode is an important problem in the magnetron of the kind above described.

The above description has referred to the employment of a rare-earth-cobalt magnet as the lower permanent magnet. If an alnico magnet were used as this lower permanent magnet, the small size which is the important advantage of the magnetron of this kind would be lost, since the alnico magnet having a small coercive force $H_c$ requires an elongated axial length. Further, it is required to increase the size of the anode cylinder from the viewpoint of minimizing leakage of the magnetic flux. This requires a structural arrangement including mounting of the vanes in spaced apart relation from the anode cylinder, resulting in complexity of the construction of the magnetron and in the increase in the cost of the magnetron.

SUMMARY OF THE INVENTION

With a view to obviate the aforementioned various problems encountered with the prior art magnetrons, it is an object of the present invention to provide an improved magnetron which is small in size and light in weight.

Another object of the present invention is to provide an inexpensive magnetron having a rational magnetic circuit by disposing one of the permanent magnets in the interior of the tube while disposing the other at the exterior of the tube, and suitably selecting the materials of these permanent magnets.

Still another object of the present invention is to provide a simple method for making a magnet structure for creating a magnetic field in a magnetron in which the directions of magnetization of a pair of magnet material members disposed opposite to each other are changed to magnetize the magnet material members in predetermined polarities.

DESCRIPTION OF THE PREFERRED EMBODIMENTS

Figure 1:
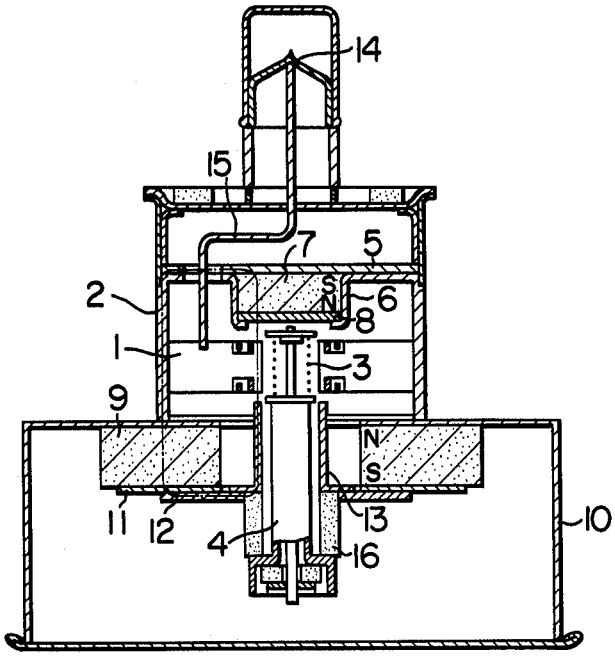
FIG. 1 is a schematic longitudinal sectional view of an embodiment of the magnetron according to the present invention.

An embodiment of the magnetron according to the present invention will now be described in detail with reference to FIG. 1. Referring to FIG. 1, a plurality of vanes 1 defining a plurality of cavities are secured to an anode cylinder 2 to constitute an anode together with the anode cylinder 2. This anode cylinder 2 is made of a ferromagnetic material such as iron and serves also as a yoke in the magnetic circuit. A heater 3 for a cathode is fixedly supported on the axis of the anode cylinder 2 by a cathode support 4, so that an interaction space is defined between the heater or cathode 3 and the vanes 1.

A yoke 5 of a ferromagnetic material is mounted on one end of the anode cylinder 2, and a columnar upper or first permanent magnet 7 and an upper or first pole piece 8 are fixed to the lower or inner surface of the yoke 5 by a clamping member 6 of a non-magnetic material. An annular lower or second permanent magnet 9 is mounted on the upper inner wall of a shield casing 10 of the magnetron with the cathode support 4 passing through the central opening of the annular second permanent magnet amd is thus located outside the tube of the magnetron. Intermediate rings 11 and 12 are mounted on the outside surface of the second permanent magnet 9, and a lower or second pole piece 13 provided around the cathode support 4 and extending through the central opening of the annular second permanent magnet 4 to the interior of the magnetron tube is magnetically coupled to the second permanent magnet 9 by these intermediate rings 11 and 12. The pole piece 13 confronts the first permanent magnet 7 with the interaction space intervening therebetween. Reference numerals 14, 15 and 16 designate a sealed end of a copper pipe in the magnetron, an antenna, and an insulating bushing of a ceramic material respectively. Further, the first and second permanent magnets are magnetically coupled with each other by the anode cylinder 2.

In the magnetron having such a construction, the first and second permanent magnets 7 and 9 have been magnetized in the illustrated polarities. Namely, the confronting sides of the first and second magnets have the same pole. Therefore, the magnetic flux emanating from the first permanent magnet 7 passes through the first pole piece 8 into the interaction space defined between the heater or cathode 3 and the vanes 1 to exert magnetic field on this interaction space, and then reaches the second pole piece 13. Thence, the magnetic flux passes through the intermediate rings 11 and 12 to reach the second permanent magnet 9, and passes then through the shield casing 10 of a magnetic material, the anode cylinder 2 and the yoke 5 to return to the first permanent magnet 7. In response to the application of voltage across the anode and the cathode, DC power is converted into high-frequency power to be taken out through the antenna 15 connected to one of the vanes 1.

The material of the first permanent magnet 7 located inside the tube may be a rare-earth-cobalt compound, and that of the second permanent magnet 9 located outside the tube may be a ferrite. The use of a ferrite magnet as the second permanent magnet 9 is advantageous in reducing the cost of the magnetic circuit compared with the prior art magnetic circuits. Further, due to the fact that the second permanent magnet 9 is encased within the shield casing 10, the size, especially, the height of the magnetron can be made smaller than that of the prior art magnetrons.

Suppose, for example, that the first permanent magnet member 7 of a rare-earth-cobalt compound has a residual magnetization $Br \approx 8$ kG and a coercive force $Hc \approx 7.9$ kOe and that the second permanent magnet member 9 of a strontium ferrite has a residual magnetization $Br \approx 4$ kG and a coercive force $Hc \approx 3.5$ kOe. In order to provide a magnetic field of 1.8 kG to an interaction space having an outer diameter of 10 mm, an inner diameter of 5 mm and a length of 14 mm, the first and second permanent magnet members are only required to have such small dimensions as follows:

| | |
|---|---|
| The first permanent magnet member 7 | |
| Outer diameter | 15 mm |
| Length in the magnetization direction | 4 mm |
| The second permanent magnet member 9 | |
| Inner diameter | 30 mm |
| Outer diameter | 70 mm |
| Length in the magnetization direction | 10 mm |

Thus, the cost of the entire magnetic circuit in the magnetron of the present invention can be made remarkably lower than that in the prior art magnetrons of this kind.

The magnetic circuit in the embodiment of the present invention is featured by the arrangement relative to the second permanent magnet 9. More precisely, the improved magnetic circuit is featured by the fact that the second permanent magnet 9 has been magnetized in the direction opposite to the direction of magnetization of the first permanent magnet 7, so that the magnetic flux passes into the tube of the magnetron through the central opening of the second permanent magnet 9.

Therefore, the first and second permanent magnets 7 and 9 in this magnetic circuit are conveniently made in a manner as described below.

In the first step, a strong magnetic field of, for example, 15 kOe is applied to the entire magnetron in order to magnetize the first and second ferromagnetic material members mounted in place in the same direction. This can be easily done by preparing a coil capable of accommodating the entire magnetron therein, placing the magnetron in the coil, and supplying necessary electric current to the coil.

Figure 2:
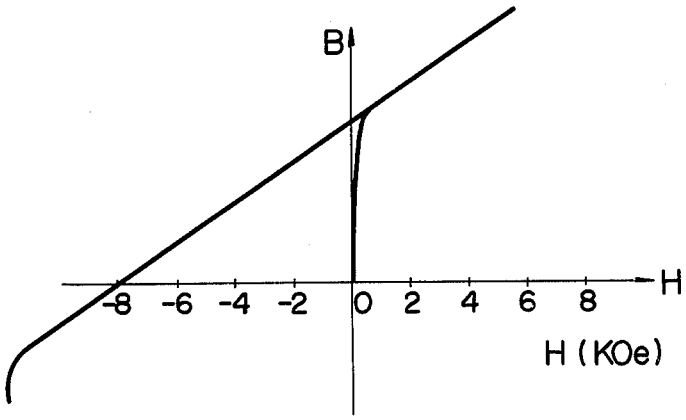
FIG. 2 shows the B-H curve of a permanent magnet of rare-earth-cobalt compound.

The first ferromagnetic material member of, for example, rare-earth (e.g. Sm)-cobalt compound is sufficiently magnetized with field strength of about 1 kOe in the initial magnetization as seen in FIG. 2. However, the permanent magnet of rare earth-cobalt compound has such a property that, once magnetized, it is not demagnetized by an inverse magnetic field of up to about 12 kOe.

In the second step, therefore, the magnetic field is now applied in the opposite direction so as to magnetize the second ferromagnetic material member alone in the direction opposite to the direction of magnetization of the first permanent magnet 7 without substantial demagnetization of the first permanent magnet 7. This second step can be easily carried out by reversing the direction of current flow through the coil by changing over a switch while holding the magnetron within the coil.

In the second step for magnetizing the second ferromagnetic permanent material member in the direction opposite to the direction of magnetization of the first permanent magnet 7, application of field strength slightly less than that in the initial magnetization was effective in providing good results. Thus, the field strength in the second magnetization step may be 10 kOe. The level of current supplied to the coil in the second step may be suitably selected depending on the factors including the magnet-forming materials.

It will thus be seen that the first and second permanent magnets 7 and 9 are made of different materials so that these materials can be magnetized in the directions opposite to each other by the simple steps above described. Such manner of magnetization can be achieved by selecting the coercive force $H_c$ of the material of the first permanent magnet 7 to be conspicuously different from that of the second permanent magnet 9. For example, the first permanent magnet 7 may have a coercive force $H_c \approx 7.9$ kOe, while the second permanent magnet 9 may have coercive force $H_c \approx 3.5$ kOe. In lieu of employing the magnetizing steps above described, the upper and lower permanent magnets may be previously magnetized in the illustrated directions of magnetization before being incorporated in the magnetron.

The magnetron embodying the present invention is assembled by combining the magnetron tube and the shield casing 10 which are separately fabricated. In assembling the magnetron, the magnetron tube including the first ferromagnetic material member for the first permanent magnet 7, cathode and other necessary elements is assembled, and after applying welding to necessary portions of the tube, the seal 14 at the end of the copper pipe is provided by welding while evacuating the interior of the magnetron tube by a vacuum pump. Subsequently, the magnetron tube thus constructed is inserted partly into the shield casing 10, and while loosely fitting the second ferromagnetic material member for the second permanent magnet 9 and intermediate ring 11 on the lower part of the magnetron tube from within the shield casing 10, the intermediate ring 12 is forced into the insulating bushing 16 to fix the second ferromagnetic material member in position. Finally, the first and second permanent magnets 7 and 9 are made from ferromagnetic material members placed in position in the manner above described to complete the magnetron. Cooling fins (not shown) are secured to the outer periphery of the anode cylinder 2. These cooling fins are fitted from below after evacuating the magnetron tube.

The magnetic field strength will not increase even when the outer diameter of the second permanent magnet 9 is selected to be a value greater than that referred to already. This is because the magnetic flux portion adjacent the outer periphery of the second permanent magnet tends to leak into the shield casing 10. For the same reason, the outer diameter of the intermediate ring 11 is preferably selected to be slightly smaller than that of the second permanent magnet 9 rather than being equal to the latter for the efficient utilization of the magnetic flux. Similarly, the diameter of the second pole piece 13 is preferably selected to be as small as possible within the allowable range of the insulation distance between it and the cathode, so that the amount of leaking magnetic flux can be minimized to ensure uniform magnetic field distribution in the interaction space.

It is apparent that the present invention is in no way limited to a specific embodiment as above described, and many other changes and modifications may be made therein without departing from the spirit of the present invention. For example, the material of the first permanent magnet 7 may be alnico, and after magnetizing this first ferromagnetic material member, a magnet of ferrite having been separately magnetized may be used as the second permanent magnet 9.

We claim:

1. A magnetron of the type comprising a cathode, an anode cylinder having a plurality of inwardly-directed vanes disposed around the cathode for defining an interaction space between the cathode and the anode within an evacuated tube, and a pair of permanent magnets disposed on axially-opposite sides of said interaction space opposite to each other for producing a magnetic field in the interaction space, wherein one of said permanent magnets which is annular in shape and axially magnetized is located outside said evacuated tube with one of its poles facing the same pole of the other permanent magnet which is located inside the tube, said magnetron further comprising a first member of magnetic material providing a pole piece for said annular permanent magnet, said first member extending from the side of said annular permanent magnet remote from the other permanent magnet and passing into the evacuated tube through the central opening of said annular permanent magnet to terminate at a position opposite the pole piece of the other permanent magnet, and a second member of magnetic material coupling magnetically the side of said annular permanent magnet opposite the other permanent magnet to the side of the other permanent magnet remote from said annular permanent magnet.

2. A magnetron according to claim 1, wherein the other permanent magnet disposed opposite said annular permanent magnet is columnar in shape and is located within the tube with one end thereof confronting said cathode, said columnar permanent magnet being secured to a yoke at the other end thereof.

3. A magnetron according to claim 1, wherein said annular permanent magnet is a ferrite magnet.

4. A megnetron according to claim 1, wherein said annular permanent magnet is encased and supported within a shield casing.

5. A method of making a magnet structure for establishing a magnetic field in a magnetron comprising the steps of forming a magnetron structure including a cathode, an anode cylinder having a plurality of vanes disposed around the cathode for defining an interaction space between the cathode and the vanes, and a pair of ferromagnetic material members disposed opposite to each other; first magnetizing said pair of ferromagnetic material members in the same direction of magnetization while in said magnetron structure; and then applying a magnetic field of polarity opposite to that used in the first magnetizing step thereby magnetizing one of said ferromagnetic material members, which is annular in shape, with a polarity opposite to the direction of magnetization of the other ferromagnetic material member.

6. A method according to claim 5, wherein the strength of the magnetic field applied for the magnetization in the second step is slightly less than that used in the first step.

7. A method of making a magnet structure for establishing a magnetic field in a magnetron including an interaction space for actuating electrons, comprising the steps of:

positioning first and second ferromagnetic material members opposite to each other with respect to said interaction space, said first member having a residual magnetization and a coercive force larger than those of said second members;

exerting a first magnetic field on said first and second members to magnetize them in a first direction; and exerting a second magnetic field on said first and second members to remagnetize only said second member in a second direction oppsite to said first direction;

whereby said positioned ferromagnetic material members are magnetized in opposite directions without being removed.

* * * * *